US007677933B2

(12) United States Patent
Copper et al.

(10) Patent No.: US 7,677,933 B2
(45) Date of Patent: Mar. 16, 2010

(54) STIRRUP-TYPE POWER UTILITY ELECTRICAL CONNECTOR ASSEMBLIES

(75) Inventors: Charles D. Copper, Hummelstown, PA (US); Dmitry Ladin, Thornhill (CA)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/930,868

(22) Filed: Oct. 31, 2007

(65) Prior Publication Data

US 2008/0050987 A1 Feb. 28, 2008

Related U.S. Application Data

(63) Continuation-in-part of application No. 11/437,480, filed on May 18, 2006, now Pat. No. 7,309,263.

(51) Int. Cl.
*H01R 4/44* (2006.01)

(52) U.S. Cl. ..... 439/781; 439/807; 174/94 S

(58) Field of Classification Search ..... 439/781, 439/782, 783, 784, 807, 894; 174/94 S
See application file for complete search history.

(56) References Cited

U.S. PATENT DOCUMENTS

| | | | | | |
|---|---|---|---|---|---|
| 3,026,497 | A | * | 3/1962 | Myers et al. | 439/781 |
| 3,088,993 | A | | 5/1963 | Matthyssee et al. | |
| 3,275,974 | A | | 9/1966 | Mixon, Jr. | |
| 4,247,159 | A | | 1/1981 | Fruchard | |
| 4,279,461 | A | | 7/1981 | Bussen et al. | |
| 4,471,159 | A | | 9/1984 | Frank, Jr. | |
| 4,600,264 | A | | 7/1986 | Counsel | |
| 4,684,196 | A | | 8/1987 | Smith et al. | |
| 4,723,921 | A | * | 2/1988 | Pooley | 439/783 |
| 4,764,131 | A | | 8/1988 | Beinhaur | |
| 4,857,020 | A | | 8/1989 | Crosby | |
| 4,872,856 | A | * | 10/1989 | Pooley et al. | 439/783 |
| 4,915,653 | A | * | 4/1990 | Mair | 439/781 |
| 4,985,003 | A | | 1/1991 | Francois et al. | |
| 5,342,224 | A | | 8/1994 | Lefavour | |
| 5,692,930 | A | | 12/1997 | Garver et al. | |
| 5,704,816 | A | * | 1/1998 | Polidori | 439/781 |
| 5,752,860 | A | * | 5/1998 | Greaves | 439/781 |

(Continued)

FOREIGN PATENT DOCUMENTS

| | | |
|---|---|---|
| DE | 537210 | 10/1931 |

OTHER PUBLICATIONS

PCT International Search Report; International Application No. PCT/US2008/012298; International Filing Date Oct. 30, 2008.

(Continued)

*Primary Examiner*—T C Patel
*Assistant Examiner*—Harshad C Patel

(57) ABSTRACT

An electrical connector assembly includes a bail, a first conductive member having a first hook portion extending from a first wedge portion, wherein the first hook portion adapted to engage a main conductor, and a second conductive member having a second hook portion extending from a second wedge portion. The second hook portion is adapted to engage the bail. The first wedge portion and the second wedge portion are adapted to nest with one another and be secured to one another to capture and electrically connect the main conductor and the bail.

20 Claims, 7 Drawing Sheets

U.S. PATENT DOCUMENTS

| | | | | |
|---|---|---|---|---|
| 6,004,165 | A * | 12/1999 | Dinh et al. | 439/783 |
| 6,086,406 | A | 7/2000 | Francois et al. | |
| 6,595,472 | B1 | 7/2003 | Pisczak | |
| 7,182,653 | B1 * | 2/2007 | Hoxha | 439/783 |
| 7,387,546 | B2 | 6/2008 | Copper et al. | |
| 7,524,217 | B2 | 4/2009 | Copper et al. | |
| 2002/0142674 | A1 | 10/2002 | Chadbourne et al. | |
| 2007/0004289 | A1 | 1/2007 | Hoxha et al. | |

OTHER PUBLICATIONS

Ampact Connectors, Apr. 17 2009. Web address: http://energy.tycoelectronics.com/rrg/amp_rrg/1-1. pp. 1-1 through 1-3.

J.D.Sprecher et al., Wedge-Connector Technology in Power Utility Applications, AMP Journal of Technology, vol. 5 Jun. 1996, pp. 4-13, Tyco Electronics Corp. Middletown, PA.

U. S. Appl. No. 12/509,246, filed Juy 24, 2009 entitled "Transverse Wedge Connector"; Gregory et al.

* cited by examiner

STIRRUP-TYPE POWER UTILITY ELECTRICAL CONNECTOR ASSEMBLIES

CROSS REFERENCE TO RELATED APPLICATIONS

This application is a continuation-in-part of U.S. application Ser. No. 11/437,480, filed May 18, 2006, and entitled "Combination Wedge Tap Connector", which is hereby incorporated by reference in its entirety.

BACKGROUND OF THE INVENTION

The subject matter herein relates generally to electrical connectors, and more particularly, to power utility connectors for providing a power take-off location from a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. For example, proper installation of such connectors is often dependent upon predetermined torque requirements of the bolt connection to achieve adequate connectivity of the main and tap conductors. Applied torque in tightening the bolted connection generates tensile force in the bolt that, in turn, creates normal force on the conductors between the connector halves. Applicable torque requirements, however, may or may not be actually achieved in the field and even if the bolt is properly tightened to the proper torque requirements initially, over time, and because of relative movement of the conductors relative to the connector pieces or compressible deformation of the cables and/or the connector pieces over time, the effective clamping force may be considerably reduced. Additionally, the force produced in the bolt is dependent upon frictional forces in the threads of the bolt, which may vary considerably and lead to inconsistent application of force among different connectors.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from Tyco Electronics Corporation of Harrisburg, Pa. and is known as an AMPACT Tap or Stirrup Connector. AMPACT connectors, however, tend to be more expensive than either bolt-on or compression connectors, and special application tooling, using explosive cartridges packed with gunpowder, has been developed to drive the wedge member into the C-shaped member. Different connectors and tools are available for various sizes of conductors in the field.

AMPACT connectors are believed to provide superior performance over bolt-on and compression connectors. For example, the AMPACT connector results in a wiping contact surface that, unlike bolt-on and compression connectors, is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

It would be desirable to provide a lower cost, more universally applicable alternative to conventional wedge connectors that provides superior connection performance to bolt-on and compression connectors.

BRIEF DESCRIPTION OF THE INVENTION

In one embodiment, an electrical connector assembly is provided including a bail, a first conductive member having a first hook portion extending from a first wedge portion, wherein the first hook portion adapted to engage a main conductor, and a second conductive member having a second hook portion extending from a second wedge portion. The second hook portion is adapted to engage the bail. The first wedge portion and the second wedge portion are adapted to nest with one another and be secured to one another to capture and electrically connect the main conductor and the bail.

Optionally, the bail has a body having first and second ends being positioned adjacent one another and captured between the second hook portion and the first wedge portion when the first and second conductive members are coupled to one another. The second hook portion may include a passage extending between an inner surface and an outer surface of the second hook portion, wherein the bail is formed such that a portion of the bail body is received within the passage. Optionally, the bail body may include an upper rail, a lower rail and side rails extending between the upper and lower rails. Each of the rails may cooperate to define the opening and the upper rail is captured between the second hook portion and the first wedge portion. The upper rail may have a stem extending therefrom into the opening, and the stem may be received within a passage extending through the second hook portion.

In another embodiment, an electrical connector assembly is provided including a bail, a first conductive member and a second conductive member separately fabricated from one another. The first and second conductive members are configured to interconnect a main conductor and the bail. Each of the first and second conductive members include a wedge portion and a deflectable channel portion extending from the wedge portion. The wedge portion of the first conductive member is configured to nest within and be secured to the wedge portion of the second conductive member, and the wedge portion of the second conductive member is configured to nest within and be secured to the wedge portion of the first conductive member. The assembly also includes a fastener extending through the wedge portion of each of the first and second conductive members, wherein the fastener is configured to fully join the first and second conductive members to one another.

In a further embodiment, an electrical connector assembly is provided for power utility transmission, wherein the assembly includes a bail, a first conductive member and a second conductive member separately fabricated from one another, wherein each of the first and second conductive members include a wedge portion and a deflectable channel portion extending from the wedge portion. The channel portion of the first conductive member is configured for receiving a main power line conductor at a spaced location from the wedge portion of the first conductive member. The channel portion of the second conductive member is configured for receiving the bail at a spaced location from the wedge portion of the second conductive member. The assembly also includes a fastener joining the wedge portions of the first and second conductive members to one another.

DETAILED DESCRIPTION OF THE INVENTION

Figure 1:
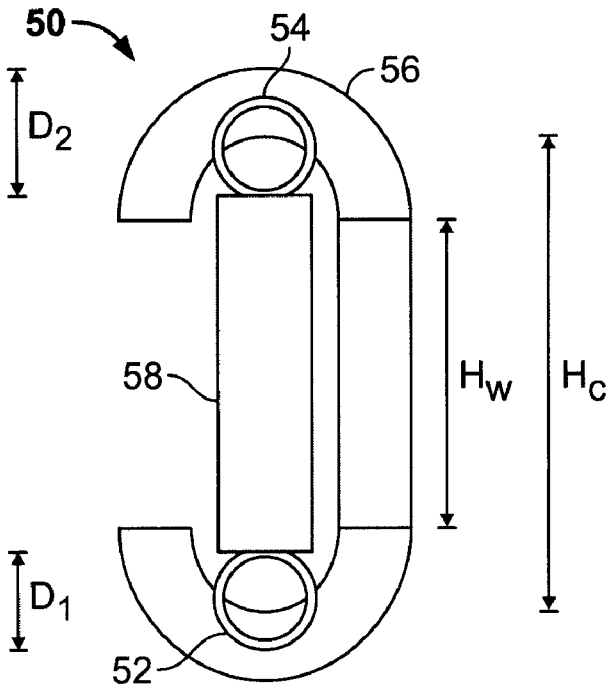
FIG. 1 (Prior Art)
FIG. 1 is a side elevational view of a known wedge connector assembly.
Figure 2:
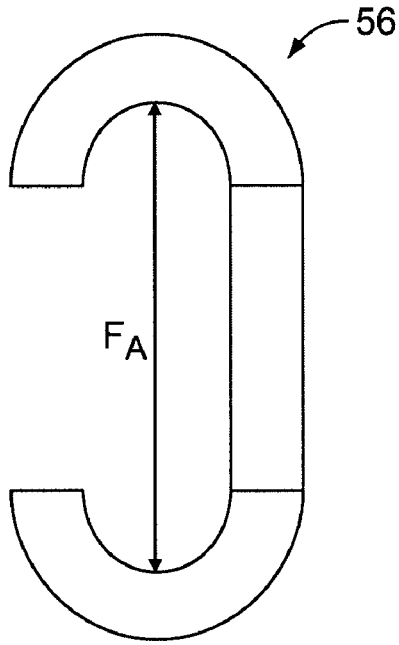
FIG. 2 (Prior Art)
FIG. 2 is a side elevational view of a portion of the assembly shown in FIG. 1.

FIGS. 1 and 2 illustrate a known wedge connector assembly 50 for power utility applications wherein mechanical and electrical connections between a tap or distribution conductor 52 and a main power conductor 54 are to be established. The connector assembly 50 includes a C-shaped spring member 56 and a wedge member 58. The spring member 56 hooks over the main power conductor 54 and the tap conductor 52, and the wedge member 58 is driven through the spring member 56 to clamp the conductors 52, 54 between the ends of the wedge member 58 and the ends of the spring member 56.

The wedge member 58 may be installed with special tooling having for example, gunpowder packed cartridges, and as the wedge member 58 is forced into the spring member 56, the ends of the spring member 56 are deflected outwardly and away from one another via the applied force $F_A$ shown in FIG. 2. Typically, the wedge member 58 is fully driven to a final position wherein the rear end of the wedge member 58 is substantially aligned with the rear edge of the spring member 56. The amount of deflection of the ends of the spring member 56 is determined by the size of the conductors 52 and 54. For example, the deflection is greater for the larger diameter conductors 52 and 54.

As shown in FIG. 1, the wedge member 58 has a height $H_W$, while the spring member 56 has a height $H_C$ between opposing ends of the spring member 56 where the conductors 52, 54 are received. The tap conductor 52 has a first diameter $D_1$ and the main conductor 54 has a second diameter $D_2$ that may be the same or different from $D_1$. As is evident from FIG. 1, $H_W$ and $H_C$ are selected to produce interference between each end of the spring member 56 and the respective conductor 52, 54. Specifically, the interference I is established by the relationship:

$$I=H_W+D_1+D_2-H_C \tag{1}$$

With strategic selection of $H_W$ and $H_C$ the actual interference I achieved may be varied for different diameters $D_1$ and $D_2$ of the conductors 52 and 54. Alternatively, $H_W$ and $H_C$ may be selected to produce a desired amount of interference I for various diameters $D_1$ and $D_2$ of the conductors 52 and 54. For example, for larger diameters $D_1$ and $D_2$ of the conductors 52 and 54, a smaller wedge member 58 having a reduced height $H_W$ may be selected. Alternatively, a larger spring member 56 having an increased height $H_C$ may be selected to accommodate the larger diameters $D_1$ and $D_2$ of the conductors 52 and 54. As a result, a user requires multiple sized wedge members 52 and/or spring members 56 in the field to accommodate a full range of diameters $D_1$ and $D_2$ of the conductors 52 and 54. Consistent generation of at least a minimum amount of interference I results in a consistent application of applied force $F_A$ which will now be explained in relation to FIG. 3.

Figure 3:
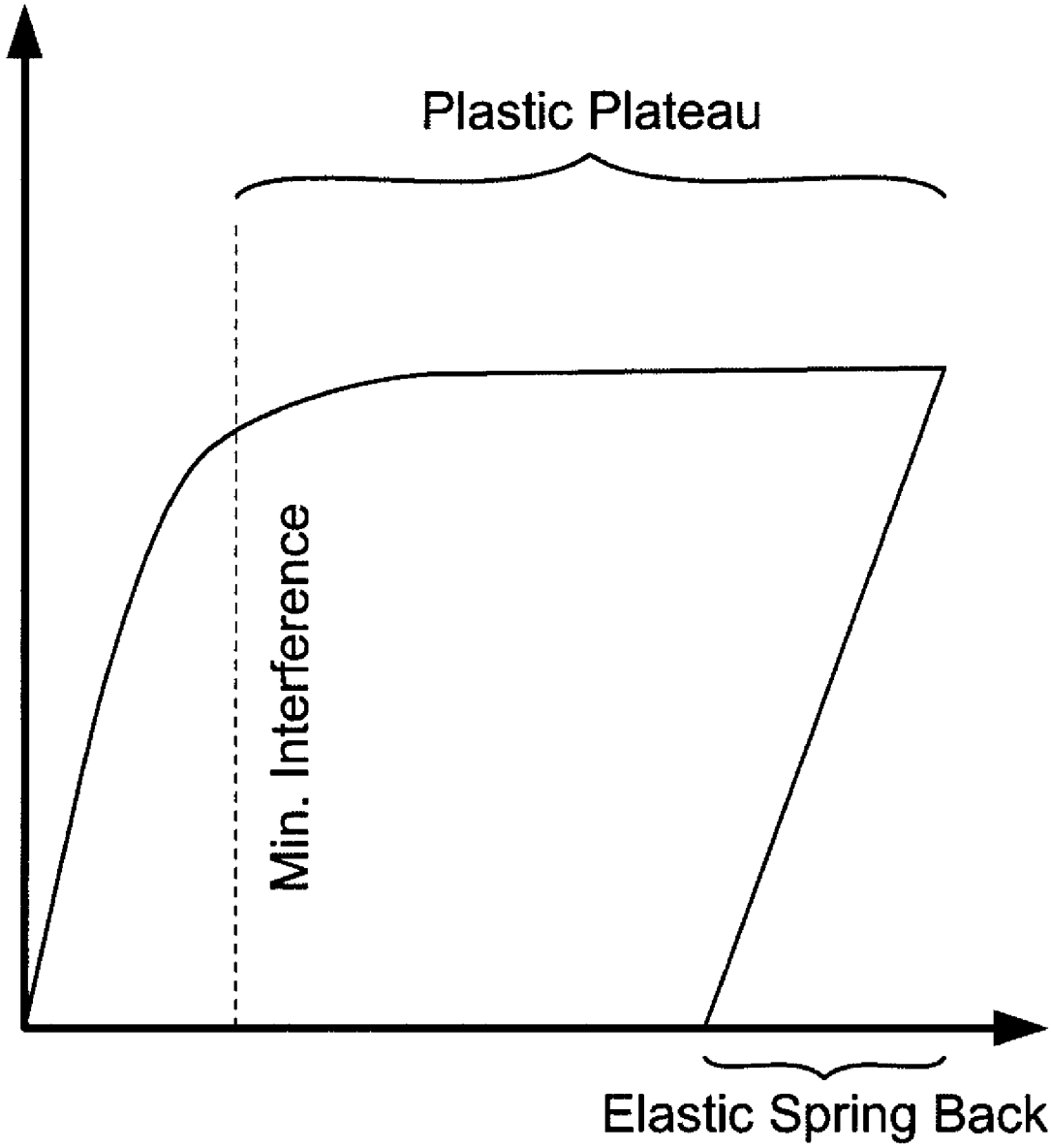
FIG. 3 is a force/displacement graph for the assembly shown in FIG. 1.

FIG. 3 illustrates an exemplary force versus displacement curve for the assembly 50 shown in FIG. 1. The vertical axis represents the applied force and the horizontal axis represents displacement of the ends of the spring member 56 as the wedge member 58 is driven into engagement with the conductors 52, 54 and the spring member 56. As FIG. 3 demonstrates, a minimum amount of interference, indicated in FIG. 3 with a vertical dashed line, results in plastic deformation of the spring member 56 that, in turn, provides a consistent clamping force on the conductors 52 and 54, indicated by the plastic plateau in FIG. 3. The plastic and elastic behavior of the spring member 56 is believed to provide repeatability in clamping force on the conductors 52 and 54 that is not possible with known bolt-on connectors or compression connectors. However, the need for a large inventory of differently sized spring members 56 and wedge members 58 renders the connector assembly 50 more expensive and less convenient than some user's desire.

Figure 4:
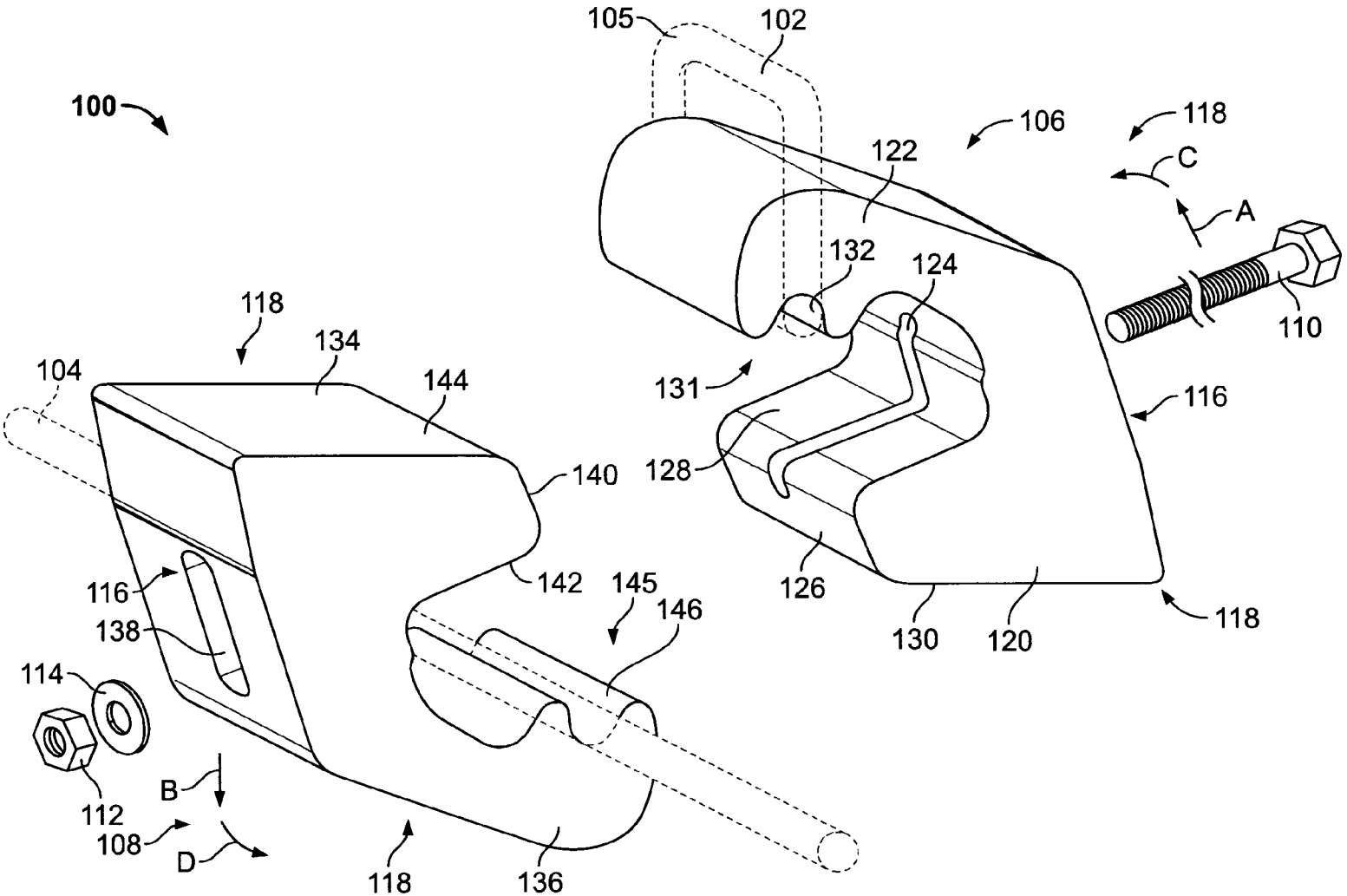
FIG. 4 illustrates a connector assembly in an unassembled condition and formed in accordance with an exemplary embodiment.

FIG. 4 is an exploded view of a connector assembly 100 formed in accordance with an exemplary embodiment and that overcomes these and other disadvantages. The connector assembly 100 is adapted for use as a stirrup connector for connecting a bail 102 (shown in phantom in FIG. 4), to a main conductor 104 (also shown in FIG. 4) of a utility power distribution system. As explained in detail below, the connector assembly 100 provides superior performance and reliability to known bolt-on and compression connectors, while providing ease of installation and greater range taking capability to known connector assemblies.

The bail 102 is used to interconnect the main conductor 104 with other utility components or equipment, such as a transformer, through the interconnection of the various components of the electrical assembly 100. The main conductor 104 is a generally cylindrical high voltage cable line. The bail 102 has a body 105 that is formed into a shape, such as the rectangular shape illustrated in FIG. 4, having an enclosed portion that defines the power take-off location. Optionally, the body 105 may represent a metallic bar that is generally cylindrical and that is formed into the rectangular shape. Alternately, the metallic bar could have various cross-sections and be formed in many common shapes.

When installed to the bail 102 and the main conductor 104, the connector assembly 100 provides electrical connectivity between the main conductor 104 and the bail 102 to feed electrical power from the main conductor 104 to the bail 102 in, for example, an electrical utility power distribution system. The connector assembly 100 may be used to provide tap connections between main conductors 104 and tap conductors via the bail 102, and may generally define a stirrup connector.

As shown in FIG. 4, the connector assembly 100 includes a tap conductive member 106, a main conductive member 108, and a fastener 110 that couples the tap conductive member 106 and the main conductive member 108 to one another. In an exemplary embodiment, the fastener 110 is a threaded member inserted through the respective conductive members 106 and 108, and a nut 112 and lock washer 114 are provided to engage an end of the fastener 110 when the conductive members 106 and 108 are assembled. While specific fastener elements 110, 112 and 114 are illustrated in FIG. 1, it is understood that other known fasteners may alternatively be used if desired.

In the illustrated embodiment, the tap conductive member 106 includes a wedge portion 120 and a channel portion 122 extending from the wedge portion 120. A fastener bore 124 is formed in and extends through at least a portion of the wedge portion 120. The fastener bore 124 may also be formed in and extend through at least a portion of channel portion 122. In an exemplary embodiment, the wedge and/or channel portions 120, 122 defines a displacement stop. The main conductive member 108 engages the displacement stop when the connector assembly is fully assembled, as described in further detail below.

The wedge portion 120 includes an abutment face 126, a wiping contact surface 128, and a conductor contact surface 130. The wiping contact surface 128 is angled with respect to the abutment face 126 and a rounded edge may define a transition between the abutment face 126 and the wiping contact surface 128. The conductor contact surface 130 extends substantially perpendicular to the abutment face 126 and obliquely with respect to the wiping contact surface 128. The conductor contact surface 130 generally faces a portion of the main conductive member 108 and engages and captures the main conductor 104 therebetween during assembly of the connector assembly 100.

The channel portion 122 extends away from the wedge portion 120 and includes a mating interface 131 that generally faces the wedge portions 120. At least one channel 132 is positioned along the mating interface 131. The channel 132 is adapted to receive the bail 102 at a spaced relation from the wedge portion 120. The channel portion 122 is reminiscent of a hook in one embodiment, and the wedge portion 120 and the channel portion 122 together have a generally C-shaped body. The tap conductive member 106 may be integrally formed and fabricated from extruded metal, together with the wedge and channel portions 120, 122 in a relatively straightforward and low cost manner.

The channel 132 is sized and shaped to cradle the bail 102 and hold the bail 102 in position during assembly of the connector assembly 100. The channel 132 includes an open side that receives the bail 102 and exposes at least a portion of the bail 102. For example, the channel 132 may wrap around the bail 102 for about 180 circumferential degrees in an exemplary embodiment, and may expose about 180 circumferential degrees of the bail 102. The open side of each channel 132 lies along the mating interface 131 and generally faces toward the wedge portion 120. In an exemplary embodiment, and as described in further detail below, the channel 132 is adapted to securely hold the bail 102 even when the main and tap conductive members 106, 108 are not coupled to one another. As such, the tap conductive member 106 and the bail may be transported or moved without the bail 102 falling out of the channel 132.

In the illustrated embodiment, the main conductive member 108 likewise includes a wedge portion 134 and a channel portion 136 extending from the wedge portion 134. A fastener bore 138 is formed in and extends through at least a portion of the wedge portion 134. The fastener bore 138 may also be formed in and extend through at least a portion of channel portion 136. In an exemplary embodiment, the wedge and/or the channel portions 134, 136 may define a displacement stop. The wedge portion 120 of the tap conductive member 106 engages the displacement stop when the connector assembly 100 is fully assembled, as described in further detail below.

The wedge portion 134 includes an abutment face 140, a wiping contact surface 142, and a conductor contact surface 144. The wiping contact surface 142 is angled with respect to the abutment face 140 and a rounded edge may define a transition between the abutment face 140 and the wiping contact surface 142. The conductor contact surface 144 extends substantially perpendicular to the abutment face 140 and obliquely with respect to the wiping contact surface 142. The conductor contact surface 144 generally faces the channel portion 122 of the tap conductive member 106 and engages and captures the bail 102 therebetween during assembly of the connector assembly 100.

The channel portion 136 extends away from the wedge portion 134 and includes a mating interface 145 that generally faces the wedge portion 120 of the tap conductive member 106. At least one channel 146 is positioned along the mating interface 145. The channel 146 is adapted to receive the main conductor 104 at a spaced relation from the wedge portion 134. The channel portion 136 is reminiscent of a hook in one embodiment, and the wedge portion 134 and the channel portion 136 together have a generally C-shaped body. The main conductive member 108 may be integrally formed and fabricated from extruded metal, together with the wedge and channel portions 134, 136 in a relatively straightforward and low cost manner.

The channel 146 is sized and shaped to cradle the main conductor 104 and hold the main conductor 104 in position during assembly of the connector assembly 100. In an exemplary embodiment, the channel 146 includes an open side that receives the main conductor 104 and exposes at least a portion of the main conductor 104. For example, the channel 146 may wrap around the main conductor 104 for about 180 circumferential degrees in an exemplary embodiment, and may expose about 180 circumferential degrees of the main conductor 104. The open side of each channel 146 lies along the mating interface 145 and generally faces toward the wedge portion 134.

The tap conductive member 106 and the main conductive member 108 are separately fabricated from one another or otherwise formed into discrete connector components and are assembled to one another as explained below. While one exemplary shape of the tap and main conductive members 106, 108 has been described herein, it is recognized that the conductive members 106, 108 may be alternatively shaped in other embodiments as desired.

In one embodiment, the wedge portions 120, 134 of the respective tap and the main conductive members 106, 108 are substantially identically formed and share the same geometric profile and dimensions to facilitate interfitting of the wedge portions 120, 134, in the manner explained below, as the conductive members 106, 108 are mated. Identical formation of the wedge portions 120, 134 provides for mixing and matching of conductive members 106, 108 for differently sized bails 102 or main conductors 104 while achieving a repeatable and reliable connecting interface via the wedge portions 120, 134. The channel portions 122, 136 of the conductive members 106 and 108, however, may be differently dimensioned as appropriate to be engaged to differently sized bails 102 or main conductors 104 while maintaining substantially the same shape of the conductive members 106, 108. The channel portions 122, 136 may include differently sized and/or shaped channels 132, 146 relative to one another. Optionally, the channel portions 122, 136 may have substantially identical geometric profiles, but may include different sized and/or shaped channels 132, 146. Alternatively, the channel portions 122, 136 may have different geometric profiles to accommodate different sized or shaped channels 132, 146. The conductive members 106, 108 both have U-shaped bodies creating a space between the wedge portions 120, 134 and the channel portions 122, 136, respectively. The U-shaped bodies have open ends. The wedge portion 120 of the first conductive member 106 is received through the open end of the second conductive member 108 and is configured to nest within the space created between the wedge portion 134 and the channel portion 136 of the second conductive member 108. The wedge portion 120 and the channel portion 122 being generally aligned with one another on opposite sides of the space. The wedge portion 120 and the channel portion 122 extend to outer ends with the open end of the space between the outer ends of the wedge and channel portions 120, 122. The wedge portion 134 of the second conductive member 108 is received through the open end of the first conductive member 106 and is configured to nest within the space created between the wedge portion 120 and the channel portion 122 of the first conductive member 106. The wedge portion 134 and the channel portion 136 being generally aligned with one another on opposite sides of the space. The wedge portion 134 and the channel portion 136 extend to outer ends with the open end of the space between the outer ends of the wedge and channel portions 134, 136.

As shown in FIG. 4, prior to assembly, the tap conductive member 106 and the main conductive member 108 are generally inverted relative to one another with the respective wedge portions 120, 134 facing one another. The fastener bores 114, 138 are aligned with one another to facilitate extension of the fastener 110 therethrough. The channel portion 122 of the tap conductive member 106 extends away from the wedge portion 120 in a first direction, indicated by the arrow A, and the channel portion 136 of the main conductive member 108 extends from the wedge portion 134 in a second direction, indicated by arrow B that is generally opposite to the direction of arrow A. Additionally, the channel portion 122 of the tap conductive member 106 extends around the bail 102 in a circumferential direction indicated by the arrow C, while the channel portion 136 of the main conductive member 108 extends circumferentially around the main conductor 104 in the direction of arrow D that is generally opposite to arrow C.

Figure 5:
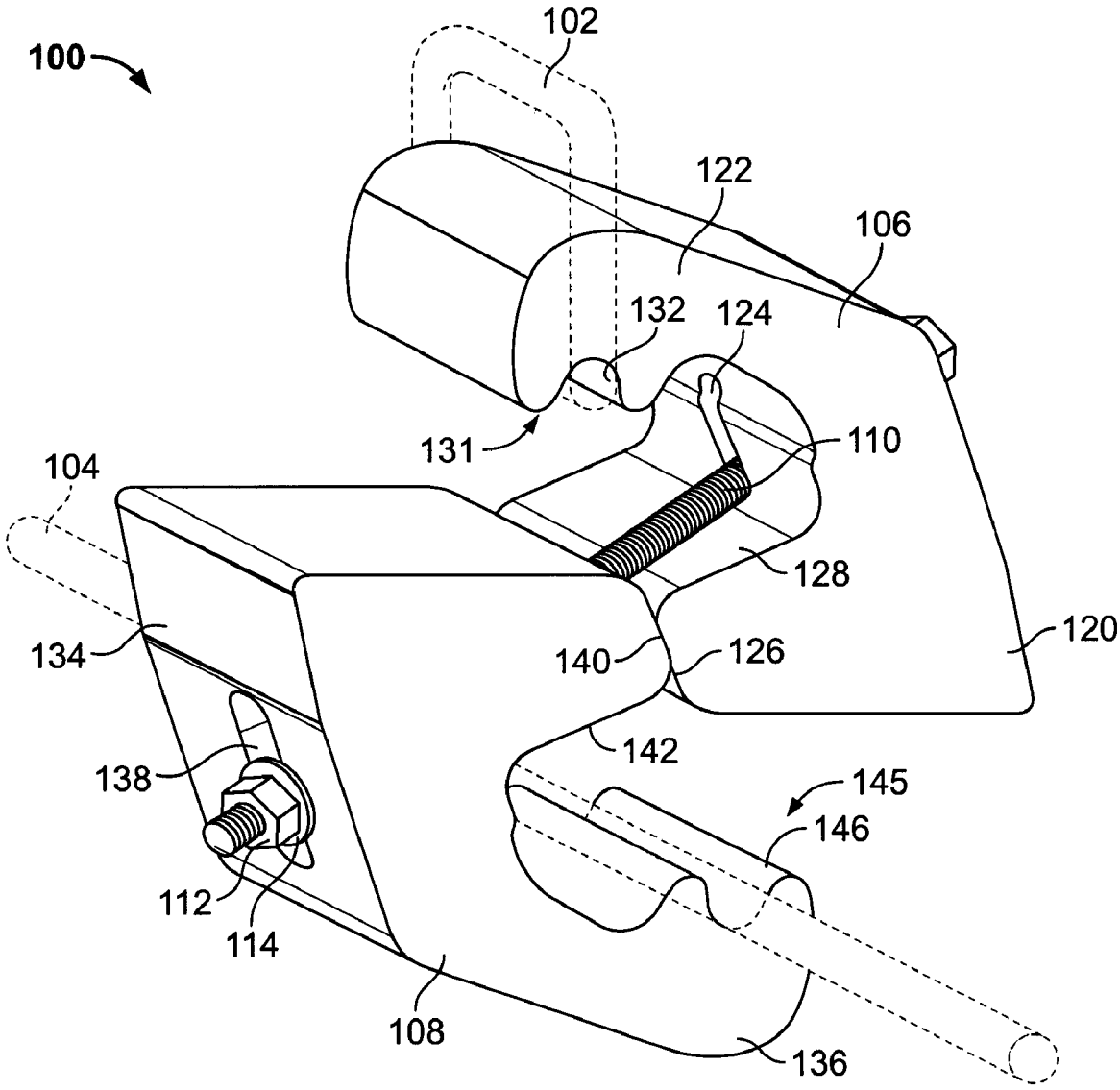
FIG. 5 illustrates the assembly shown in FIG. 4 in a partially mated position.
Figure 6:
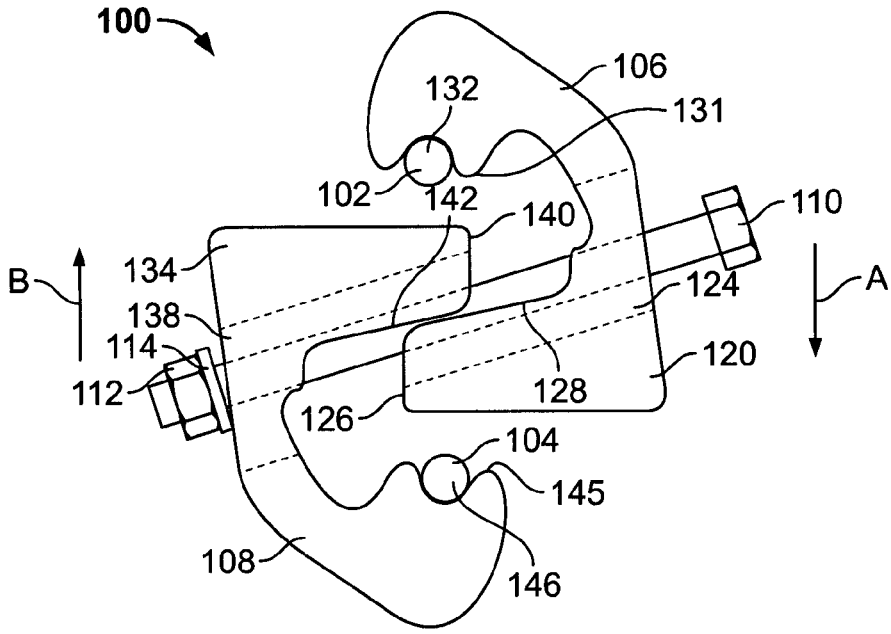
FIG. 6 is a cross sectional view of the assembly shown in FIG. 4 in a partially mated position.
Figure 7:
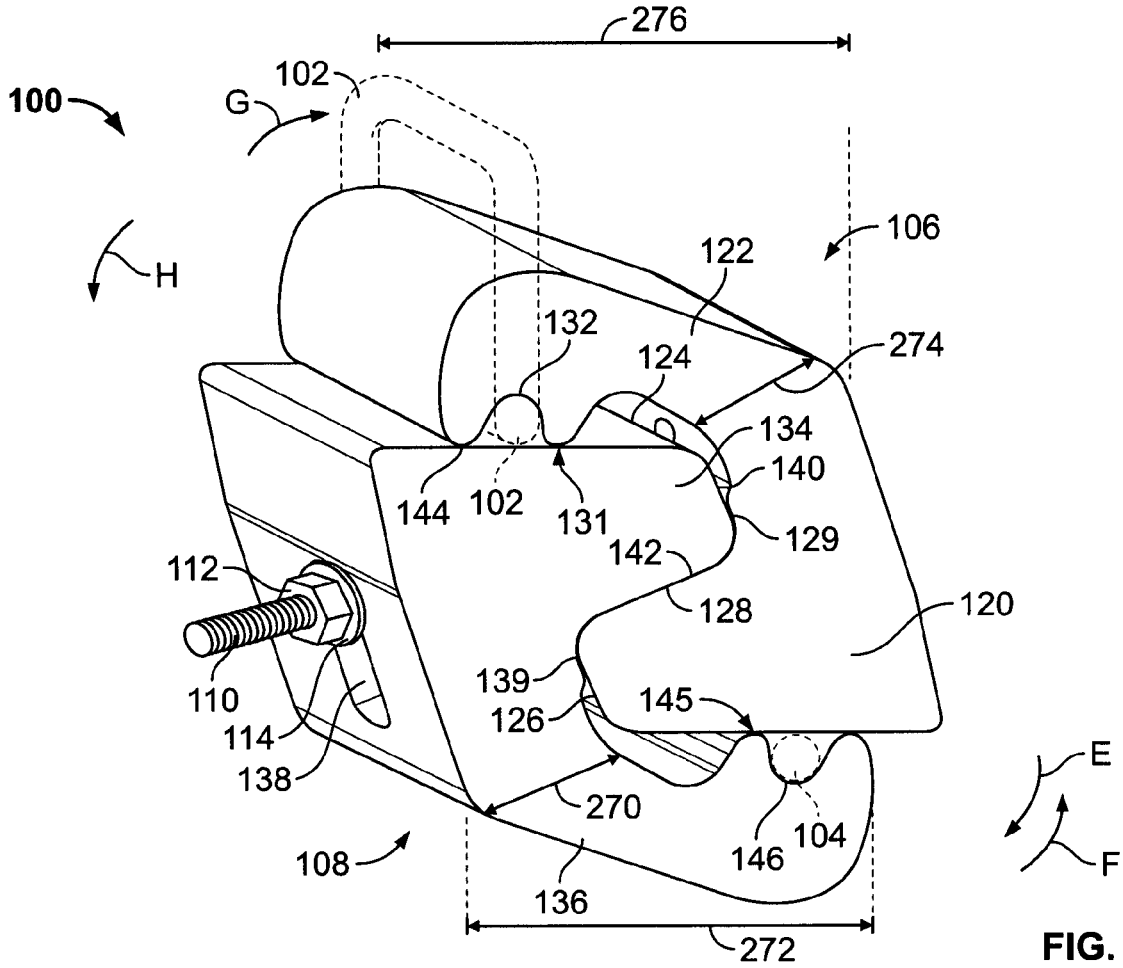
FIG. 7 illustrates the assembly shown in FIG. 4 in a mated position.

The assembly of the connector assembly 100 may be understood with reference to FIGS. 4-7. As indicated above, FIG. 4 illustrates the connector assembly 100 in an unassembled position. FIG. 5 illustrates the connector assembly 100 in a partially mated position. FIG. 6 is a cross sectional view of the connector assembly 100 in another partially mated position. FIG. 7 illustrates the connector assembly 100 in a mated position.

During assembly, when the bail 102 and main conductor 104 are placed in, and cradled by, the respective channel portions 122, 136, and when the conductive members 106, 108 are coupled together by the fastener elements 110, 112, 114, the abutment faces 126, 140 are aligned in an unmated condition as shown in the perspective view in FIG. 5, and in the side elevational view in FIG. 6. The connector assembly 100 may be preassembled into the configuration shown in FIGS. 5 and 6, and the bail 102 and main conductor 104 may be positioned within respective ones of the channels 132, 146 relatively easily. As seen in FIGS. 5 and 6, and because the opening of the fastener bores 124, 138 (shown in phantom in FIG. 6) are larger than an outer diameter of the fastener 110, the fastener 110 is positionable in a first angular orientation through the wedge portions 120 and 134.

As illustrated in FIGS. 5-7, the relative size of the fastener bores 124, 138 with respect to the fastener 110 permits the fastener 110 to float or move angularly with respect to an axis of the bores 124, 138 as the conductive members 106, 108 are moved to a fully mated position, which is illustrated in FIG. 7. More particularly, the abutment faces 126, 140 of the wedge portions 120, 134 are moved in sliding contact with one another in the directions of arrows A and B as shown in FIG. 5 until the wiping contact surfaces 128, 142 are brought into engagement as shown in FIG. 6, and the wedge portions 120, 124 may then be moved transversely into a nested or interfitted relationship as shown in FIG. 7 with the wiping contact surfaces 128, 132 in sliding engagement. The wedge portions 120, 124 continue to move in the directions of arrows A and B as the fastener is tightened in addition to moving in a direction that is transverse to the arrows A and B. As such, the fastener 110 drives the wedge portion 120 in a direction that is non-parallel to the fastener axis of the fastener bore 124 and the fastener drives the wedge portion 124 in a direction that is non-parallel to the fastener axis of the fastener bore 138. All the while, and as demonstrated in FIGS. 5-7, the fastener 110 self adjusts its angular position with respect to the fastener bores as the fastener 110 moves from the initial position shown in FIG. 5 to a final position shown in FIG. 7. In the final, mated position, the fastener 110 extends obliquely to each of the fastener bores 124, 138, and the nut 112 may be tightened to the fastener 110 to secure the conductive members 106, 108 to one another.

FIG. 7 illustrates the connector assembly 100 in a fully mated position with the nut 112 tightened to the fastener 110. In the fully mated position, the tap and main conductive members 106, 108 cooperate to capture the bail 102 and the main conductor 104. For example, the bail 102 is positioned within, and cradled by, the channel 132 of the tap conductive member 106. The bail 102 also engages, and makes direct electrical contact with, the conductor contact surface 144 of the main conductive member 108. Likewise, the main conductor 104 is positioned within, and cradled by, the channel 146 of the main conductive member 108. The main conductor 104 also engages, and makes direct electrical contact with, the conductor contact surface 130 of the tap conductive member 106.

During assembly, as the conductive members 106, 108 are moved through the positions shown in FIGS. 5-7, the wiping contact surfaces 128, 142 slidably engage one another and provide a wiping contact interface that ensures adequate electrically connectivity. The angled wiping contact surfaces 128, 142 provide a ramped contact interface that displaces the conductor contact surfaces 130, 144 in opposite directions indicated by arrows A and B as the wiping contact surfaces 128, 142 are engaged. In addition, the conductor contact surfaces 130, 144 provide wiping contact interfaces with the conductors 102 and 104 as the connector assembly 100 is installed.

Movement of the conductor contact surfaces 130, 144 in the opposite directions of arrows A and B clamps the bail 102 and the main conductor 104 between the wedge portions 120 and 134, and the opposing channel portions 122, 136. The mating interfaces 131, 145 of the channel portions 122, 136 are brought in close proximity to, and possibly abutting contact with, the wedge portions 120, 134 to the mated position, such as the position shown in FIG. 7. In the mated position, the conductive members 106, 108 substantially enclose portions of the bail 102 and the main conductor 104 within the connector assembly 100. In one embodiment, the abutment faces 126, 140 of the wedge portions 120, 134 contact the displacement stops of the opposing conductive members 108 and 106 when the connector assembly 100 is fully mated. In such a position, the wedge portions 120, 134 are nested or mated with one another in an interfitting relationship with the wiping contact surfaces 128 and 142, the abutment faces 126 and 140, and the channel portions 122 and 136 providing multiple points of mechanical and electrical contact to ensure electrical connectivity between the conductive members 106 and 108.

In the fully mated position, such as the position shown in FIG. 7, the main conductor 104 is captured between the channel portion 136 of the main conductive member 108 and the conductor contact surface 130 of the tap conductive member wedge portion 120. Likewise, the bail 102 is captured between the channel portion 122 of the tap conductive member 106 and the conductor contact surface 144 of the main conductive member wedge portion 134. As the wedge portion 120 engages the main conductive member 108 and clamps the main conductor 104 against the channel portion 136 of the main conductive member 108, the channel portion 136 is deflected in the direction of arrow E. The channel portion 136 is elastically and plastically deflected in an outward direction indicated by arrow E, resulting in a spring back force in the direction of arrow F, opposite to the direction of arrow E, to provide a clamping force on the conductor 104. The amount of deflection, and the amount of clamping force, may be affected by a thickness 270 of the channel portion 136, a length 272 of the channel portion 136, the type of material of the main conductive member 108, and the like. A large contact force, on the order of about 4000 lbs is provided in an exemplary embodiment, and the clamping force ensures adequate electrical connectivity between the main conductor 104 and the connector assembly 100. Additionally, elastic spring back of the channel portion 136 provides some tolerance for deformation or compressibility of the main conductor 104 over time, because the channel portion 136 may effectively return in the direction of arrow F if the main conductor 104 deforms due to compression forces. Actual clamping forces may be lessened in such a condition, but not to such an amount as to compromise the integrity of the electrical connection. In an exemplary embodiment, the spring back allows a range of tolerance within the elastic range of the channel portion 136.

Likewise, the wedge portion 134 of the main conductive member 108 clamps the bail 102 against the channel portion 122 of tap conductive member 106 and the channel portion 122 is deflected in the direction of arrow G. The channel portion 122 is elastically and plastically deflected in an outward direction indicated by arrow G, resulting in a spring back force in the direction of arrow H opposite to the direction of arrow G. The amount of deflection, and the amount of clamping force, may be affected by a thickness 274 of the channel portion 122, a length 276 of the channel portion 122, the type of material of the tap conductive member 106, and the like. A large contact force, on the order of about 4000 lbs is provided in an exemplary embodiment, and the clamping force ensures adequate electrical connectivity between the bail 102 and the connector assembly 100. Additionally, elastic spring back of the channel portion 122 provides some tolerance for deformation or compressibility of the bail 102 over time, because the channel portion 122 may simply return in the direction of arrow H if the bail 102 deforms due to compression forces. Actual clamping forces may be lessened in such a condition, but not to such an amount as to compromise the integrity of the electrical connection.

Unlike known bolt connectors, torque requirements for tightening of the fastener 110 are not required to satisfactorily install the connector assembly 100. When the abutment faces 126, 140 of the wedge portions 120, 134 contact the channel portions 136, 122, the connector assembly 100 is fully mated. By virtue of the fastener elements 110, 112 and the combined wedge action of the wedge portions 120, 134 to deflect the channel portions 122, 136, the connector assembly 100 may be installed with hand tools, and specialized tooling, such as explosive cartridges, is avoided.

When fully mated, the abutment faces 126 and 140 may engage the displacement stops, which define and limit a final displacement relation between the tap and main conductive members 106, 108. The displacement stops define a final mating position between the tap and main conductive members 106 and 108 independent of an amount of force induced upon the bail 102 and the main conductor 104 by the main and tap conductive members 108 and 106. In an alternative embodiment, the abutment faces 126, 130 may be positioned a distance from the displacement stops in the final mating position.

Optionally, the displacement stops may be created from a stand off provided on one or both of the main and tap conductive members 108 and 106. For example, the stand off may be positioned proximate the wedge portions 120, 134 and extend outward therefrom. The stand off provides a gap between the channel portions 122, 136 and the wedge portions 134, 120, respectively, which allows the channel portions 122, 136 to flex and/or move without engaging the abutment faces 140, 126 of the respective wedge portions 134, 120. Alternatively, the displacement stops may be created as mating notches provided in the wiping contact surfaces 128 and 142, where the notches engage one another to limit a range of travel of the main and tap conductive members 108 and 106 toward one another.

The displacement stops allows the nut 112 and fastener 110 to be continuously tightened until the abutment faces 126, 140 fully seat against the channel portions 136, 122, independent of, and without regard for, any normal forces created by the tap and main conductors 102, 104. The contact forces are created by interference between the channel portions 136, 122, wedge portions 120, 134, and the bail 102 and main conductor 104. It is not necessary to measure the bolt torque in the mating the connector assembly 100 as the connector assembly 100 is fully mated when the main and tap conductive members 106, 108 are joined to a predetermined position or relative displacement. In the fully mated condition, the interference between the bail 102 and the main conductor 104 and the connector assembly 100 produces a contact force adequate to provide a good electrical connection.

It is recognized that effective clamping force on the bail 102 and main conductor 104 is dependent upon the geometry of the wedge portions, dimensions of the channel portions, and size of the conductors used with the connector assembly 100. Thus, with strategic selections of angles for the wiping contact surfaces 128, 142 for example, the thicknesses 274, 270 and lengths 276, 272 of the channel portions 122, 136, respectively, and the size and positioning of the bail 102 and main conductor 104, varying degrees of clamping force may be realized when the conductive members 106 and 108 are used in combination as described above.

It is therefore believed that the connector assembly 100 provides the performance of conventional wedge connector systems in a lower cost connector assembly that does not require specialized tooling and a large inventory of parts to meet installation needs. Using low cost extrusion fabrication processes and known fasteners, the connector assembly 100 may be provided at low cost, while providing increased repeatability and reliability as the connector assembly 100 is installed and used. The combination wedge action of the conductive members 106 and 108 provides a reliable and consistent clamping force on the bail 102 and main conductor 104 and is less subject to variability of clamping force when installed than either of known bolt-on or compression-type connector systems.

Figure 8:
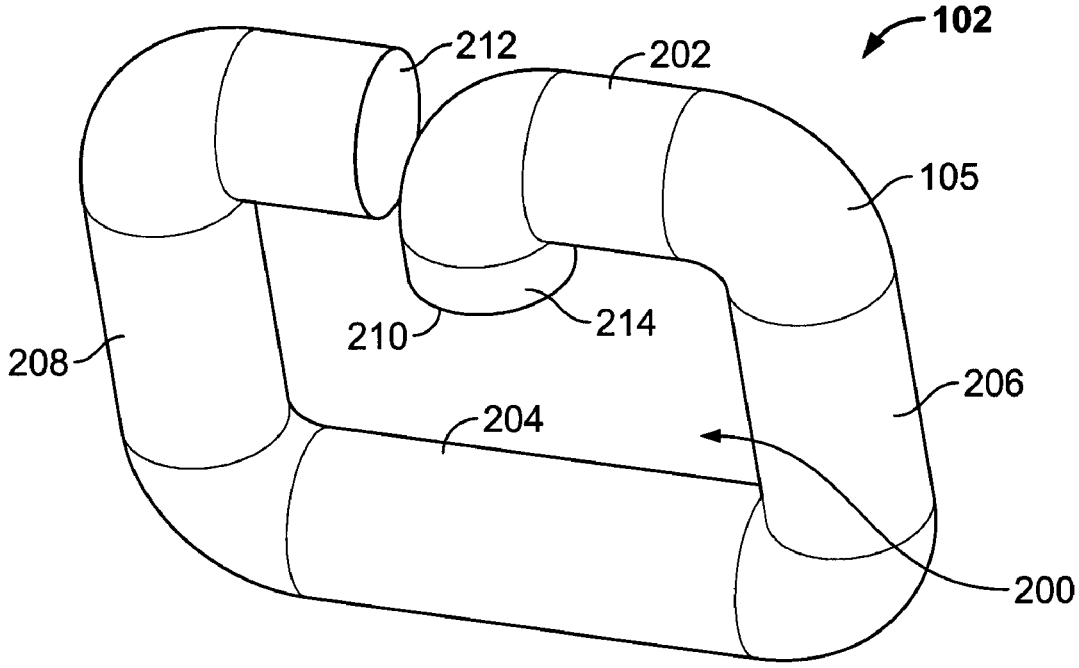
FIG. 8 is a perspective view of a bail for the connector assembly shown in FIG. 4.

FIG. 8 is a perspective view of the bail 102. The bail 102 includes the body 105 that is formed for connection with the tap conductive member 106 (shown in FIG. 4) and a power take-off component (not shown) for the tap conductor. In the illustrated embodiment, the bail body 105 is generally cylindrical and formed (e.g. bent) into a generally rectangular shape, however the bail 102 may have other shapes that would accomplish mating engagement with the power take-off component.

The bail 102 defines an opening 200 that is configured to receive the power take-off component. In an exemplary embodiment, the bail includes an upper rail 202, a lower rail 204 and side rails 206, 208 that define the opening 200. The bail 102 includes ends 210, 212 that are positioned proximate one another along the upper rail 202. In an exemplary embodiment, one of the ends 210 is bent at approximately a right angle such that the end 210 extends into the opening 200. The portion of the bail 102 at the end 210 that is bent into the opening 200 defines a stem 214. In an alternative embodiment, both ends 210, 212 are bent to define the stem 214.

Figure 9:
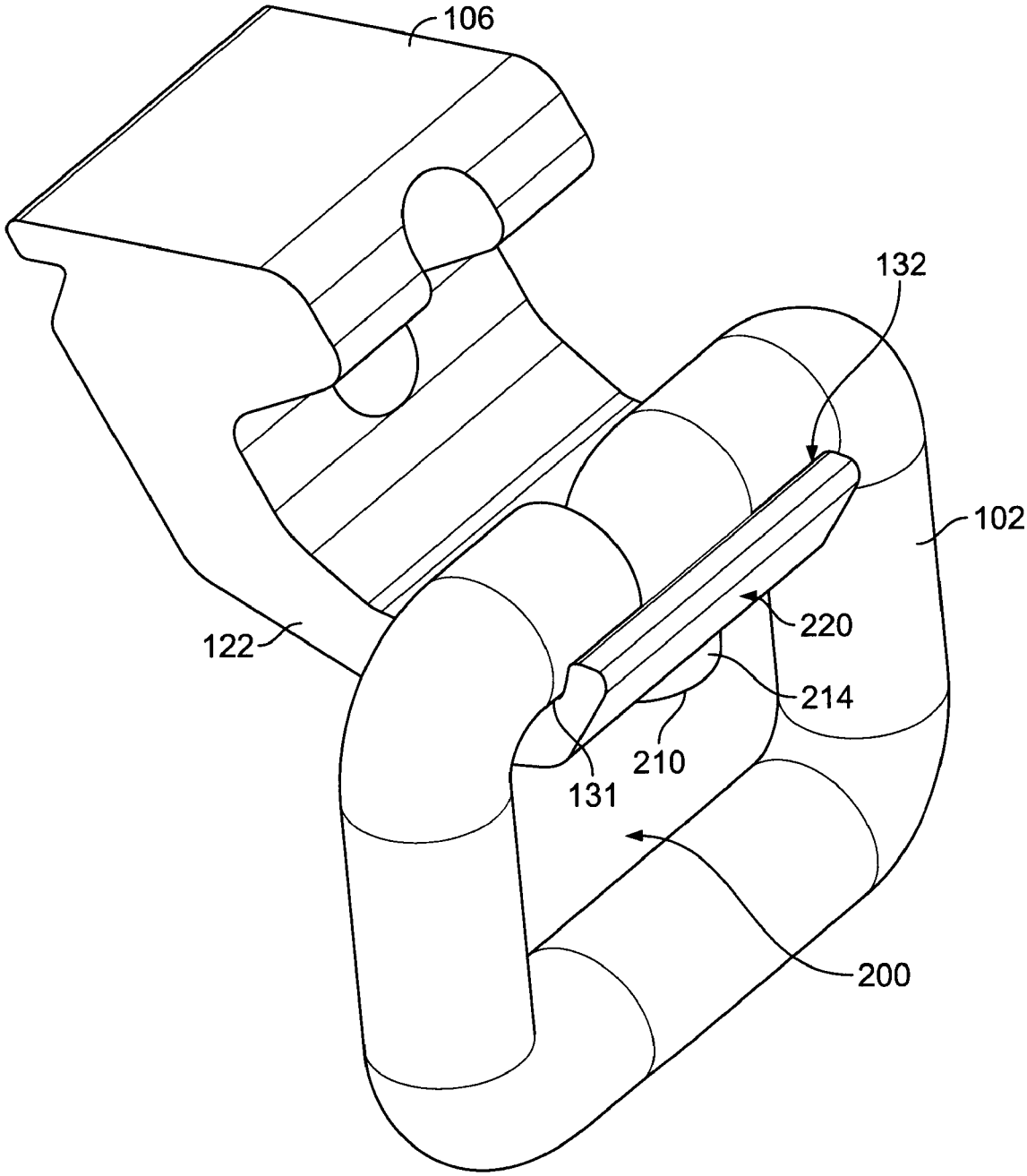
FIG. 9 illustrates the bail shown in FIG. 8 mounted to a conductive member of the connector assembly shown in FIG. 4.

FIG. 9 illustrates the bail 102 loaded into the channel 132 of the tap conductive member 106. When assembled, a section of the channel portion 122 is positioned within the opening 200. At least a portion of the opening 200 remains open for receiving the power take-off (not shown) for the tap conductor.

When assembled, the upper rail 202 of the bail 102 is positioned along the mating interface 131 of the channel 132. In an exemplary embodiment, the tap conductive member 106 includes a passage 220 through the channel portion 122. The passage 220 opens to the channel 132 such that the stem 214 of the bail 102 extends at least partially through the passage 220. For example, in the illustrated embodiment, the end 210 is shown as extending entirely through the passage 220. When the stem 214 is positioned in the passage 220, the relative positions of the bail 102 with respect to the tap conductive member 106 may be maintained. As such, the bail 102 and tap conductive member 106 may be transported or moved to the assembly area as a unit without the bail 102 falling out of the channel 132. Optionally, the end 210 may be flattened or otherwise manipulated to capture the stem 214 within the passage 220 such that the bail 102 is permanently coupled to the tap conductive member 106. When the bail 102 is received within the channel 132, the tap conductive member 106 may be coupled to the main conductive member 108 (shown in FIG. 4), such as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector assembly comprising:

a bail having a body including an upper rail, a lower rail and side rails extending between the upper and lower rails, the upper, lower and side rails cooperate to define an opening, wherein at least one of the upper, lower and side rails has a stem extending therefrom into the opening;

a first conductive member comprising a first hook portion extending from a first wedge portion, the first hook portion adapted to engage a main conductor; and a second conductive member comprising a second hook portion extending from a second wedge portion, the second hook portion adapted to engage the bail such that the bail is captured between the first wedge portion and the second hook portion, wherein the first wedge portion and the second wedge portion are adapted to nest with one another such that ramp surfaces of the first and second wedge portions engage one another and slide along one another during assembly to capture and electrically connect the main conductor and the bail.

2. The connector assembly of claim 1, wherein the bail has a body forming an opening, the body has first and second ends being positioned adjacent one another and captured between the second hook portion and the first wedge portion when the first and second conductive members are coupled to one another.

3. The connector assembly of claim 1, wherein the second hook portion includes a passage extending between an inner surface and an outer surface of the second hook portion, the bail being formed such that a portion of the bail is received within the passage.

4. The connector assembly of claim 1, wherein the stem is received within a passage extending through the second hook portion.

5. The connector assembly of claim 1, wherein each wedge portion includes an abutment face, a wiping contact surface angled with respect to the abutment face, and a conductor contact surface extending substantially perpendicular to the abutment face, the main conductor and the bail being captured between the respective hook portions and the conductor contact surfaces of the wedge portions.

6. The connector assembly of claim 1, wherein the first hook portion is adapted to extend around the main conductor in a first direction, and the second hook portion is adapted to extend around the bail in a second direction, the second direction generally opposite to the first direction.

7. The connector assembly of claim 1, wherein the first wedge portion and the second wedge portion are substantially identically formed.

8. The connector assembly of claim 1, further comprising a fastener coupling the first wedge portion to the second wedge portion.

9. The connector assembly of claim 1, wherein the wedge portions of the first and second conductive members have conductor contact surfaces generally opposite the corresponding ramp surfaces, wherein the ramp surfaces are non-parallel with respect to the conductor contact surfaces, and the ramp surfaces drive the conductor contact surfaces generally away from one another during assembly.

10. An electrical connector assembly comprising:

a bail;

a first conductive member and a second conductive member separately fabricated from one another, the first and second conductive members being configured to interconnect a main conductor and the bail, each of the first and second conductive member comprising a wedge portion and a deflectable channel portion extending from the wedge portion such that the wedge portion and the channel portion define a generally U-shaped body creating a space therebetween with an open end, the wedge portion and the channel portion generally aligned with one another on opposite sides of the space and extending to outer ends with the open end between the outer ends of the wedge and channel portions, wherein the wedge portion of the first conductive member is received through the open end and is configured to nest within the space created between the wedge portion and the channel portion of the second conductive member, and wherein the wedge portion of the second conductive member is received through the open end and is configured to nest within the space created between the wedge portion and the channel portion of the first conductive member, the wedge portion of the first conductive member engaging the wedge portion of the second conductive member to drive the wedge portion of the second conductive member and the channel portion of the first conductive member relatively closer to one another; and a fastener extending through the wedge portion of each of the first and second conductive members, wherein the fastener is configured to fully join the first and second conductive members to one another.

11. The connector assembly of claim 10, wherein the bail has a body defining an opening, the body has first and second ends being positioned adjacent one another and captured between the channel portion of the second conductive member and the wedge portion of the first conductive member.

12. The connector assembly of claim 10, wherein the channel portion of the second conductive member includes a passage extending between an inner surface and an outer surface thereof, the bail being formed such that a portion of the bail is received within the passage.

13. The connector assembly of claim 10, wherein the bail has a body defining an opening, the bail further including a stem extending from the body, the stem being received within a passage extending through the channel portion of the second conductive member.

14. The connector assembly of claim 10, wherein the main conductor is captured between the channel portion of the first conductive member and the wedge portion of the second conductive member, and further wherein the bail is captured between the channel portion of the second conductive member and the wedge portion of the first conductive member when the first and second conductive members are joined to one another.

15. The connector assembly of claim 10, wherein the channel portion of the first conductive member is adapted to receive the main conductor at a spaced location from the wedge portion of the first conductive member and the channel portion of the second conductive member is adapted to receive the bail at a spaced location from the wedge portion of the second conductive member.

16. The connector assembly of claim 10, wherein the channel portion of the first conductive member extends circumferentially around the main conductor in a first direction, and the channel portion of the second conductive member extends circumferentially around the bail in a second direction, the second direction being opposite to the first direction.

17. An electrical connector assembly for power utility transmission, the assembly comprising:

a bail;

a first conductive member and a second conductive member separately fabricated from one another, each of the first and second conductive members comprising a wedge portion and a deflectable channel portion extending from the wedge portion;

the channel portion of the first conductive member configured for receiving a main power line conductor at a spaced location from the wedge portion of the first conductive member;

the channel portion of the second conductive member configured for receiving the bail at a spaced location from the wedge portion of the second conductive member; and a fastener extending along a fastener axis for joining the wedge portions of the first and second conductive members to one another, the fastener driving the first wedge portion toward the bail in a direction that is non-parallel to the fastener axis and the fastener driving the second wedge portion toward the main power line conductor in a direction that is non-parallel to the fastener axis.

18. The connector assembly of claim 17, wherein the bail has a body defining an opening, the body has first and second ends being positioned adjacent one another and captured between the channel portion of the second conductive member and the wedge portion of the first conductive member.

19. The connector assembly of claim 17, wherein the channel portion of the second conductive member includes a passage extending between an inner surface and an outer surface thereof, the bail being formed such that a portion of the bail is received within the passage.

20. The connector assembly of claim 17, wherein the wedge portions of the first and second conductive members have angled ramp surfaces that engage one another and conductor contact surfaces generally opposite the corresponding ramp surfaces, wherein the ramp surfaces drive the conductor contact surfaces generally away from one another during tightening of the fastener.

* * * * *